US010369418B2

(12) United States Patent
Madson et al.

(10) Patent No.: US 10,369,418 B2
(45) **Date of Patent: *Aug. 6, 2019**

(54) GOLF BALL DIMPLE PLAN SHAPE

(71) Applicant: Acushnet Company, Fairhaven, MA (US)

(72) Inventors: Michael R. Madson, Easton, MA (US); Nicholas M. Nardacci, Barrington, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/953,785

(22) Filed: Apr. 16, 2018

(65) Prior Publication Data

US 2018/0229083 A1 Aug. 16, 2018

Related U.S. Application Data

(63) Continuation-in-part of application No. 15/228,502, filed on Aug. 4, 2016, now Pat. No. 9,943,728.

(51) Int. Cl.
*A63B 37/00* (2006.01)

(52) U.S. Cl.
CPC ..... *A63B 37/0007* (2013.01); *A63B 37/002* (2013.01); *A63B 37/0006* (2013.01); *A63B 37/0016* (2013.01); *A63B 37/0019* (2013.01); *A63B 37/009* (2013.01); *A63B 37/0089* (2013.01)

(58) Field of Classification Search
CPC ..... A63B 37/0004; A63B 37/0006; A63B 37/0007
See application file for complete search history.

(56) References Cited

U.S. PATENT DOCUMENTS

| | | | | |
|---|---|---|---|---|
| 5,566,943 | A | 10/1996 | Boehm | |
| 6,254,496 | B1 * | 7/2001 | Maehara | A63B 37/0004 473/378 |
| 6,729,976 | B2 | 5/2004 | Bissonnette et al. | |
| 6,796,912 | B2 | 9/2004 | Dalton et al. | |
| 8,632,426 | B2 | 1/2014 | Madson et al. | |
| 9,345,931 | B2 * | 5/2016 | Kim | A63B 37/0006 |
| 2012/0165130 | A1 | 6/2012 | Madson et al. | |
| 2013/0172123 | A1 | 7/2013 | Nardacci et al. | |
| 2017/0136302 | A1 | 5/2017 | Nardacci et al. | |
| 2017/0136304 | A1 | 5/2017 | Nardacci et al. | |
| 2017/0136305 | A1 | 5/2017 | Nardacci et al. | |
| 2018/0193703 | A1 * | 7/2018 | Nardacci | A63B 37/0007 |

* cited by examiner

*Primary Examiner* — John E Simms, Jr.
(74) *Attorney, Agent, or Firm* — Mandi B. Milbank

(57) ABSTRACT

The present invention relates to golf balls having improved packing efficiency and aerodynamic characteristics and a high degree of dimple interdigitation. In particular, the present invention relates to a golf ball including at least a portion of dimples having a plan shape defined by low frequency periodic functions having high amplitudes. The present invention is also directed to methods of developing the dimple plan shape geometries, as well as methods of making the finished golf balls with the inventive dimple patterns applied thereto.

16 Claims, 13 Drawing Sheets

GOLF BALL DIMPLE PLAN SHAPE

CROSS-REFERENCE TO RELATED APPLICATIONS

This application is a continuation-in-part of U.S. patent application Ser. No. 15/228,502, filed Aug. 4, 2016, the entire disclosure of which is hereby incorporated herein by reference.

FIELD OF THE INVENTION

The present invention relates to golf balls having improved packing efficiency and aerodynamic characteristics and a high degree of dimple interdigitation. The improved characteristics are obtained through the use of specific dimple arrangements and dimple plan shapes. In particular, the present invention relates to a golf ball including at least a portion of dimples having a plan shape defined by low frequency periodic functions having high amplitudes.

BACKGROUND OF THE INVENTION

Aerodynamic forces acting on a golf ball are typically resolved into orthogonal components of lift ($F_L$) and drag ($F_D$). Lift is defined as the aerodynamic force component acting perpendicular to the flight path. It results from a difference in pressure that is created by a distortion in the air flow that results from the back spin of the ball. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Drag is defined as the aerodynamic force component acting opposite to the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. The air separates from the surface of the ball, leaving a large turbulent flow area with low pressure, i.e., the wake. The difference between the high pressure in front of the ball and the low pressure behind the ball reduces the ball speed and acts as the primary source of drag.

Lift and drag, among other aerodynamic characteristics of a golf ball are influenced by the external surface geometry of the ball, which includes the dimples thereon. As such, the dimples on a golf ball play an important role in controlling those parameters. For example, the dimples on a golf ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

The design variables associated with the external surface geometry of a golf ball, e.g., surface coverage, dimple pattern, and individual dimple geometries, provide golf ball manufacturers the ability to control and optimize ball flight. However, there has been little to no focus on the plan shape of a dimple, i.e., the perimeter or boundaries of the dimple on the golf ball outer surface, as a key variable in achieving such control and optimization. In particular, since the bifurcation created by the plan shape of a dimple creates a large transition from the external surface geometry, it is considered to play a role in aerodynamic behavior. As such, there remains a need for a dimple plan shape that maximizes surface coverage uniformity and packing efficiency, while maintaining desirable aerodynamic characteristics.

SUMMARY OF THE INVENTION

The present invention is directed to a golf ball dimple having a perimeter defined by a low frequency periodic function along a simple closed path according to the following function:

$$Q(x)=F_{path}(l,scl,x)*F_{periodic}(s,a,p,x)$$

where $F_{path}$ is a path function of length l, with scale factor scl, defined along the vertices x, and $F_{periodic}$ is a periodic function with sharpness factor s, amplitude a, and period p defined at the vertices x; wherein the period p is about 15 or less, for example, about 12 or less, and the perimeter has an amplitude A such that the maximum absolute distance of any point on the perimeter from the simple closed path is about 0.015 inches to about 0.050 inches. In one embodiment, the periodic function is selected from a sine, cosine, sawtooth wave, triangle wave, square wave, or arbitrary function. In another embodiment, the path function is any simple closed path that is symmetrical about two orthogonal axes, for example, a circle, ellipse, or square. In still another embodiment, the golf ball dimple has a Degree of Interdigitation DOI of about 0.05 to about 0.50. In yet another embodiment, the perimeter has an amplitude A such that the maximum absolute distance of any point on the perimeter from the simple closed path is about 0.025 inches to about 0.050 inches. In yet another embodiment, each one of the dimples having a perimeter defined by a low frequency periodic function along a simple closed path comprises a first dimple profile and a second dimple profile, the first dimple profile having a first edge angle ($\Phi_{EDGE1}$) and a second edge angle ($\Phi_{EDGE2}$) and the second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values.

The present invention is further directed to a golf ball having a substantially spherical surface, including a plurality of dimples on the surface, wherein at least a portion of the plurality of dimples have a plan shape defined by a low frequency periodic function along a simple closed path according to the following function:

$$Q(x)=F_{path}(l,scl,x)*F_{periodic}(s,a,p,x)$$

where $F_{path}$ is a path function of length l, with scale factor scl, defined along the vertices x, and $F_{periodic}$ is a periodic function with sharpness factor s, amplitude a, and period p defined at the vertices x, wherein the period p is about 15 or less, for example, about 12 or less, the plan shape has an amplitude A such that the maximum absolute distance of any point on the plan shape from the simple closed path is about 0.015 inches to about 0.050 inches, and the portion of the plurality of dimples have a Degree of Interdigitation DOI of about 0.05 to about 0.50, for example, of about 0.10 to about 0.30. In one embodiment, the plan shape has an amplitude A such that the maximum absolute distance of any point on the plan shape from the simple closed path is about 0.025 inches to about 0.050 inches. In another embodiment, the periodic function is selected from a sine, cosine, sawtooth wave, triangle wave, square wave, or arbitrary function. In still another embodiment, at least a portion includes about 50 percent or more of the dimples on the golf ball. In yet another embodiment, each one of the dimples having a non-circular plan shape defined by a low frequency periodic function along a simple closed path comprises a first dimple profile and a second dimple profile, the first dimple profile having a first edge angle ($\Phi_{EDGE1}$) and a second edge angle ($\Phi_{EDGE2}$) and the second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values.

The present invention is further directed to a golf ball including an outer surface having a plurality of dimples arranged in a dimple pattern thereon, wherein at least a portion of the plurality of dimples arranged in the dimple pattern have a non-circular plan shape defined by a low frequency periodic function along a simple closed path and the portion of the plurality of dimples arranged in the dimple pattern have a Degree of Interdigitation DOI of about 0.05 to about 0.40, for example, of about 0.10 to about 0.30. In one embodiment, the periodic function is selected from a sine, cosine, sawtooth wave, triangle wave, square wave, or arbitrary function. In another embodiment, the low frequency periodic function has a period p of about 15 or less. In still another embodiment, the low frequency periodic function of the non-circular plan shape has a period p equal to the number of neighboring dimples. In yet another embodiment, the low frequency periodic function of the non-circular plan shape has a period p that is a scalar multiple of the number of neighboring dimples. In still another embodiment, the non-circular plan shape is defined by a low frequency periodic function according to the following function:

$$Q(x)=F_{path}(l,scl,x)*F_{periodic}(s,a,p,x)$$

where $F_{path}$ is a path function of length l, with scale factor scl, defined along the vertices x, and $F_{periodic}$ is a periodic function with sharpness factor s, amplitude a, and period p defined at the vertices x. In yet another embodiment, each one of the dimples having a non-circular plan shape defined by a low frequency periodic function along a simple closed path comprises a first dimple profile and a second dimple profile, the first dimple profile having a first edge angle ($\Phi_{EDGE1}$) and a second edge angle ($\Phi_{EDGE2}$) and the second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values.

BRIEF DESCRIPTION OF THE DRAWINGS

Further features and advantages of the invention can be ascertained from the following detailed description that is provided in connection with the drawings described below.

DETAILED DESCRIPTION

Figure 1:
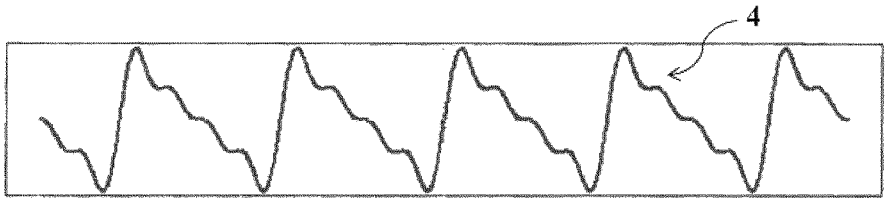
FIG. 1 illustrates the waveform of a sawtooth wave periodic function approximated by a Fourier series for use in a dimple plan shape according to the present invention.

The present invention is directed to golf balls having improved aerodynamic performance due, at least in part, to the use of non-circular dimple plan shapes. In particular, the present invention is directed to a golf ball that includes at least a portion of its dimples having a plan shape defined by low frequency periodic functions having high amplitudes. The present invention is also directed to methods of generating the dimple plan shape geometries, as well as methods of making the finished golf balls with the inventive dimple patterns applied thereto. Further, the present invention is directed to a parameter for quantifying the measure of interdigitation or interlockability of neighboring dimples produced in accordance with the present invention.

Advantageously, the dimple plan shapes produced in accordance with the present invention combine a low period of oscillation with a high degree of deviation to form plan shapes defined by low frequency, high amplitude periodic functions. When the inventive plan shapes are applied to dimples on a golf ball, the resulting dimple patterns exhibit a high degree of interlockability or interdigitation of neighboring dimples. This, in turn, provides for improved dimple packing efficiency and increased surface coverage. As a result, the present invention provides a golf ball manufacturer the ability to fine tune golf ball aerodynamic characteristics by controlling the external surface geometry of the golf ball.

In addition, while golf balls with circular plan shape dimples are indistinguishable from one another in the market place, the plan shapes of dimples according to the present invention are unique in appearance. For example, in one embodiment, the low frequency periodic functions defining the plan shapes of the present invention provide perimeters having a distinct appearance. In turn, the plan shapes of the present invention provide for golf ball surface textures having distinct visual appearances as well as golf balls having improved aerodynamic characteristics.

Dimple Plan Shapes

The present invention contemplates dimples having a non-circular plan shape defined by low frequency, high amplitude periodic functions along a simple closed path. In particular, golf balls formed according to the present invention include at least about 10 percent or more of dimples having a plan shape defined by low frequency, high amplitude periodic functions. In another embodiment, the golf balls formed according to the present invention include at least about 25 percent or more of dimples having a plan shape defined by low frequency, high amplitude periodic functions. In still another embodiment, the golf balls formed according to the present invention include at least about 50 percent or more of dimples having a plan shape defined by low frequency, high amplitude periodic functions. By the term, "plan shape," it is meant the shape of the, perimeter of the dimple, or the demarcation between the dimple and the outer surface of the golf ball or fret surface.

According to the present invention, at least one dimple is formed using a simple closed path, i.e., a path that starts and ends at the same point without traversing any defining point or edge along the path more than once. For example, the present invention contemplates dimples formed using any simple cycle known in graph theory including circles and polygons. In one embodiment, the simple closed path is any path that is symmetrical about two orthogonal axes. In another embodiment, the simple closed path is a circle, ellipse, square, or polygon. In still another embodiment, the simple closed path is an arbitrary path. In this aspect, a suitable dimple shape according to the present invention may be based on any path that starts and ends at the same point without intersecting any defining point or edge.

The present invention contemplates the use of periodic functions to form the dimple shape including any function that repeats its values at regular intervals or periods. For the purposes of the present invention, a function f is periodic if $$f(x)=f(x+p) \tag{1}$$

for all values of x where p is the period. In particular, the present invention contemplates any periodic function that is non-constant, non-zero.

In one embodiment, the periodic function used to form the dimple shape includes a trigonometric function. Examples of trigonometric functions suitable for use in accordance with the present invention include, but are not limited to, sine and cosine. Indeed, the waveform of a cosine periodic function may be used to form a dimple shape in accordance with the invention. The cosine wave suitable for use in accordance with the present invention has a shape identical to that of a sine wave, except that each point on the cosine wave occurs exactly ¼ cycle earlier than the corresponding point on the sine wave.

In another embodiment, the periodic function suitable for use in forming a dimple shape in accordance with the present invention includes a non-smooth periodic function. Non-limiting examples of non-smooth periodic functions suitable for use with the present invention include, but are not limited to, sawtooth wave, triangle wave, square wave, and cycloid. In one embodiment, a sawtooth wave is suitable for use in forming a dimple shape in accordance with the present invention. In particular, a dimple in accordance with the present invention may have a shape based on a non-sinusoidal waveform that ramps upward and then sharply drops.

In another embodiment, a triangle wave is suitable for use in forming a dimple shape in accordance with the present invention. The triangle wave suitable for use in forming a dimple shape in accordance with the present invention is a non-sinusoidal waveform that is a periodic, piecewise linear, continuous real function. In yet another embodiment, a square wave is suitable for use in forming a dimple shape in accordance with the present invention. For example, the square wave suitable for use in forming a dimple shape in accordance with the present invention is a non-sinusoidal periodic waveform in which the amplitude alternates at a steady frequency between fixed minimum and maximum values, with the same duration at minimum and maximum.

In this aspect of the invention, any of the above-mentioned periodic functions may be constructed as an infinite series of sines and cosines using Fourier series expansion for use in forming a dimple shape in accordance with the present invention. In particular, the Fourier series of a function, which is given by equations (2)-(5), is contemplated for use in forming the dimple shape according to the present invention:

$$f(x) = \frac{1}{2}a_0 + \sum_{n=1}^{\infty} a_n\cos(nx) + \sum_{n=1}^{\infty} b_n\sin(nx), \tag{2}$$

where:

$$a_0 = \frac{1}{\pi}\int_{-\pi}^{\pi} f(x)dx \tag{3}$$

$$a_n = \frac{1}{\pi}\int_{-\pi}^{\pi} f(x)\cos(nx)dx \tag{4}$$

$$b_n = \frac{1}{\pi}\int_{-\pi}^{\pi} f(x)\sin(nx)dx \tag{5}$$

and n=1, 2, 3.

In addition, the following Fourier series are contemplated for use in forming the dimple shape in accordance with the present invention.

TABLE 1

FOURIER SERIES OF NON-SMOOTH PERIODIC FUNCTIONS

| Periodic Function | Fourier Series |
|---|---|
| Sawtooth wave | $\frac{1}{2} - \frac{1}{n}\sum_{n=1}^{\infty}\frac{1}{\pi}\sin\left(\frac{n\pi x}{L}\right)$ |
| Triangle wave | $\frac{8}{\pi^2}\sum_{n=1,3,5\ldots}^{\infty}\frac{(-1)^{\frac{(n-1)}{2}}}{n^2}\sin\left(\frac{n\pi x}{L}\right)$ |
| Square wave | $\frac{4}{\pi}\sum_{n=1,3,5\ldots}^{\infty}\frac{1}{n}\sin\left(\frac{n\pi x}{L}\right)$ |

Figure 2:
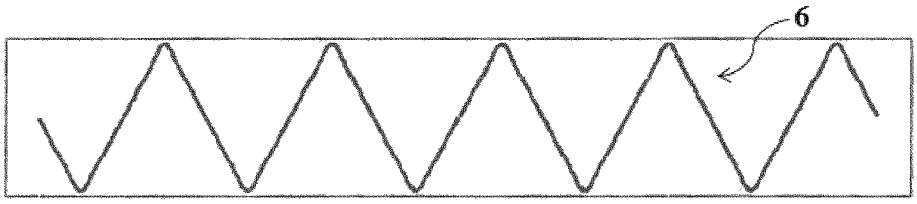
FIG. 2 illustrates the waveform of a triangle wave periodic function approximated by a Fourier series for use in a dimple plan shape according to the present invention.
Figure 3:
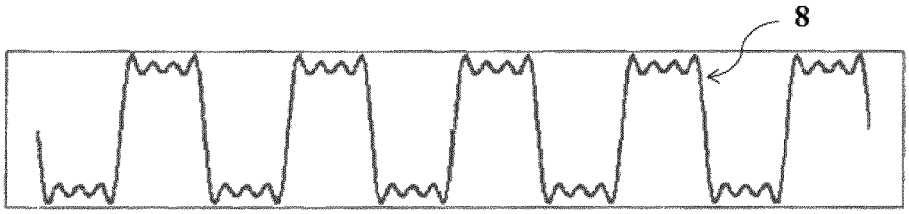
FIG. 3 illustrates the waveform of a square wave periodic function approximated by a Fourier series for use in a dimple plan shape according to the present invention.

For example, FIG. 1 illustrates the waveform of a sawtooth wave approximated by a Fourier series. In particular, FIG. 1 illustrates a sawtooth wave 4 approximated by a four-term Fourier series expansion for use in forming a dimple shape in accordance with the present invention. In addition, FIG. 2 illustrates the waveform of a triangle wave approximated by a Fourier series. FIG. 2 illustrates a triangle wave 6 approximated by a four-term Fourier series expansion for use in forming a dimple shape in accordance with the present invention. Further, FIG. 3 illustrates the waveform of a square wave approximated by a Fourier series. For example, FIG. 3 illustrates a square wave 8 approximated by a four-term Fourier series expansion for use in forming a dimple shape in accordance with the present invention. While the above examples demonstrate four-term Fourier series expansions, it will be understood by those of ordinary skill in the art that more than or less than four terms may be used to approximate the non-sinusoidal waveforms. In addition, any method of approximation known to one of ordinary skill in the art may be used in this aspect of the invention.

Figure 4:
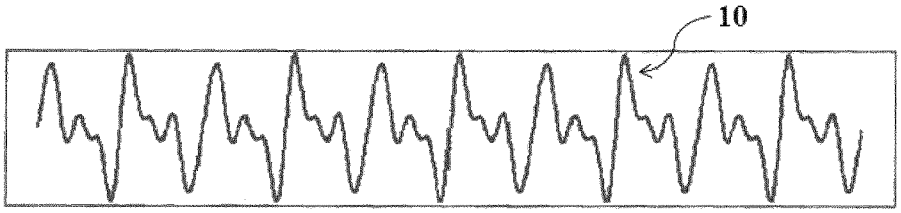
FIG. 4 illustrates the waveform of an arbitrary periodic function for use in a dimple plan shape according to the present invention.

In yet another embodiment, the present invention contemplates arbitrary periodic functions, or linear combinations of periodic functions for use in forming a dimple shape in accordance with the present invention. Accordingly, in one embodiment of the present invention, an arbitrary periodic function may be created using a linear combination of sines and cosines to form a dimple shape in accordance with the present invention. In this aspect, FIG. 4 illustrates the waveform of an arbitrary periodic function contemplated by the present invention. As shown in FIG. 4, the arbitrary wave 10 represents a linear combination of sines and cosines.

According to the present invention, the plan shape of the dimple may be produced by projecting or mapping any of the above-referenced periodic functions onto the simple closed path. In general, the mathematical formula representing the projection or mapping of the periodic function onto the simple closed path is expressed as equation (6):

$$Q(x)=F_{path}(l,scl,x)*F_{periodic}(s,a,p,x) \tag{6}$$

where $F_{path}$ represents the simple closed path on which the periodic function is mapped or projected with length (l), scale factor (scl), defined along the vertices (x), and $F_{periodic}$ is any suitable periodic function with sharpness factor (s), amplitude (a), and period (p) defined at the vertices (x).

In one embodiment, the projection may be described in terms of how the path function is altered by the periodic function. For example, the resulting vector Q(x) represents the altered coordinates of the path. Indeed, the "path function" contemplated by the present invention includes any of the simple paths discussed above.

In this aspect of the invention, the resulting vector Q(x) may also be a suitable path for a dimple plan shape according to the present invention. That is, the resulting vector Q(x) could itself become a path to which another periodic function is mapped. Indeed, any of the periodic functions disclosed above may be mapped to the resulting vector Q(x) to form a dimple plan shape in accordance with the present invention.

The length (l) and scale factor (scl), may vary depending on the desired size of the dimple. However, in one embodiment, the length is about 0.150 inches to about 1.400 inches. In another embodiment, the length is about 0.250 inches to about 1.200 inches. In still another embodiment, the length is about 0.500 inches to about 0.800 inches.

The variable, $F_{periodic}$, of equation (6) will vary based on the desired periodic function. The sharpness factor (s) is a scalar value and defines the mean of the periodic function. Generally, small values of s produce periodic functions that greatly alter the plan shape, while larger values of s produce periodic functions having a diminished influence on the plan shape. Indeed, as will be apparent to one of ordinary skill in the art, once an amplitude value is chosen, the sharpness factor (s) may be varied depending on the desired amount of alteration to the plan shape. In one embodiment, the sharpness factor (s) ranges from about 5 to about 60. In another embodiment, the sharpness factor (s) ranges from about 8 to about 55. In still another embodiment, the sharpness factor (s) ranges from about 15 to about 50.

Amplitude is defined as the absolute value of the maximum distance from the path during one period of the periodic function. The function amplitude (a) affects the dimple plan shape in the opposite sense as sharpness factor (s). In this aspect, the sharpness factor (s) and amplitude (a) parameters are both used to control the mapped periodic function used to define Q(x). For example, the sharpness factor (s) and amplitude (a) parameters control the severity of the perimeter of the final plan shape. Indeed, sharpness and amplitude parameters are both used to "tune" the final plan shape geometry. That is, the plan shapes of the present invention can be tailored to maximize neighboring dimple interdigitation, thus improving packing efficiency and surface coverage.

In one embodiment, the function amplitude (a) ranges from about 0.25 to 10. In another embodiment, the amplitude (a) ranges from about 0.5 to 5. In still another embodiment, the amplitude (a) ranges from about 1 to 3. For example, the amplitude (a) may be about 1.

Figure 5:
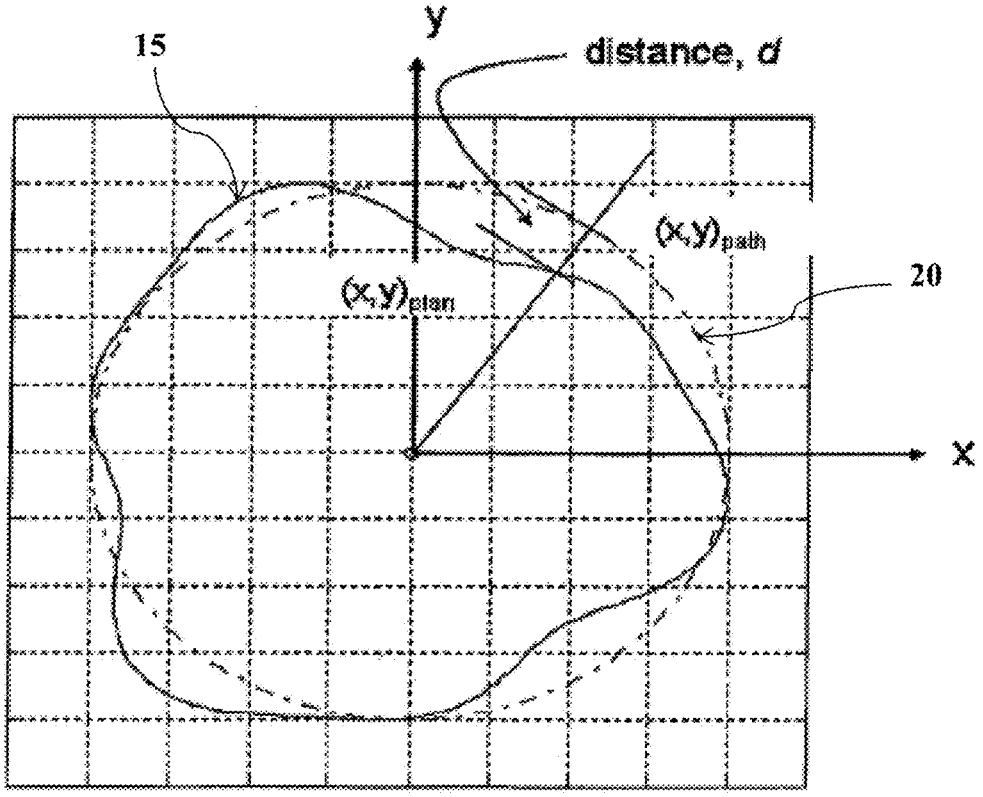
FIG. 5 illustrates a dimple plan shape produced in accordance with the present invention.

In another embodiment, the plan shape amplitude (A), defines the maximum variation between the plan shape and the path during one period of the periodic function. The plan shape amplitude (A) can be expressed as the maximum absolute distance from the path. In this aspect, the absolute distance (d) is defined by the following equation (7):

$$d=\sqrt{(x_{circle}-x_{plan})^2+(y_{circle}-y_{plan})^2} \tag{7}$$

where d is a directed distance calculated along a line from the plan shape centroid through corresponding points on the plan shape and path. For example, FIG. 5 illustrates a plan shape constructed in accordance with the present invention having an absolute distance (d). As shown in FIG. 5, the distance (d) defines the maximum variation between the plan shape 15 and the path 20 (represented by the dashed line) during one period of the periodic function. The maximum value for all calculated distances (d) is the maximum absolute distance ($d_{max}$).

High amplitude periodic functions are contemplated for use in forming a dimple shape in accordance with the present invention. That is, the present invention contemplates plan shapes having a high degree of deviation from the path. In one embodiment, the amplitude of the dimple plan shape is such that the maximum absolute distance ($d_{max}$) of any point on the plan shape from the simple path is greater than 0.015 inches. In another embodiment, the amplitude of the dimple plan shape is such that the maximum absolute distance ($d_{max}$) of any point on the plan shape from the simple path is greater than 0.025 inches. In still another embodiment, the amplitude of the dimple plan shape is such that the maximum absolute distance, ($d_{max}$) of any point on the plan shape from the simple path is greater than 0.035 inches. In yet another embodiment, the amplitude of the dimple plan shape is such that the maximum absolute distance, ($d_{max}$), of any point on the plan shape from the simple path is greater than 0.050 inches.

The period (p) refers to the horizontal distance required for the periodic function to complete one cycle. As will be apparent to one of ordinary skill in the art, the period may vary based on the periodic function. However, in one embodiment, the present invention contemplates periodic functions having a period of less than about 15. In another embodiment, the present invention contemplates periodic functions having a period of less than about 12. In still another embodiment, the present invention contemplates periodic functions having a period of less than about 10. In yet another embodiment, the present invention contemplates periodic functions having a period of less than about 8. For example, the present invention contemplates periodic functions having a period of less than about 5.

The period of the wave function is inversely proportional to the function frequency. Indeed, the frequency refers to the number of periods completed over the path function. For example, the frequency of a periodic function having a period (p) is represented by 1/p. In one embodiment, the present invention contemplates low frequency periodic functions. That is, the present invention contemplates periodic functions having a frequency of about 1/15 or more. In one embodiment, the periodic function has a frequency of about 1/12 or more. In another embodiment, the periodic function has a frequency of about 1/10 or more. In still another embodiment, the periodic function has a frequency of about 1/8 or more. In yet another embodiment, the periodic function has a frequency of about 1/5 or more.

Accordingly, by manipulating the variables of equation (6), the present invention provides for golf ball dimples having various plan shapes defined by low frequency and high amplitude periodic functions. Indeed, the plan shapes of the present invention have a low period of oscillation (for example, p less than about 15) and a high degree of deviation from the path that leads to large values of $d_{max}$ (for example, greater than about 0.015 inches). By using the low frequency and high amplitude periodic functions disclosed herein, the present invention provides for dimple plan shapes and dimple patterns with a high degree of interlockability or interdigitation of neighboring dimples and, thus, high packing efficiency and surface coverage.

Figure 6:
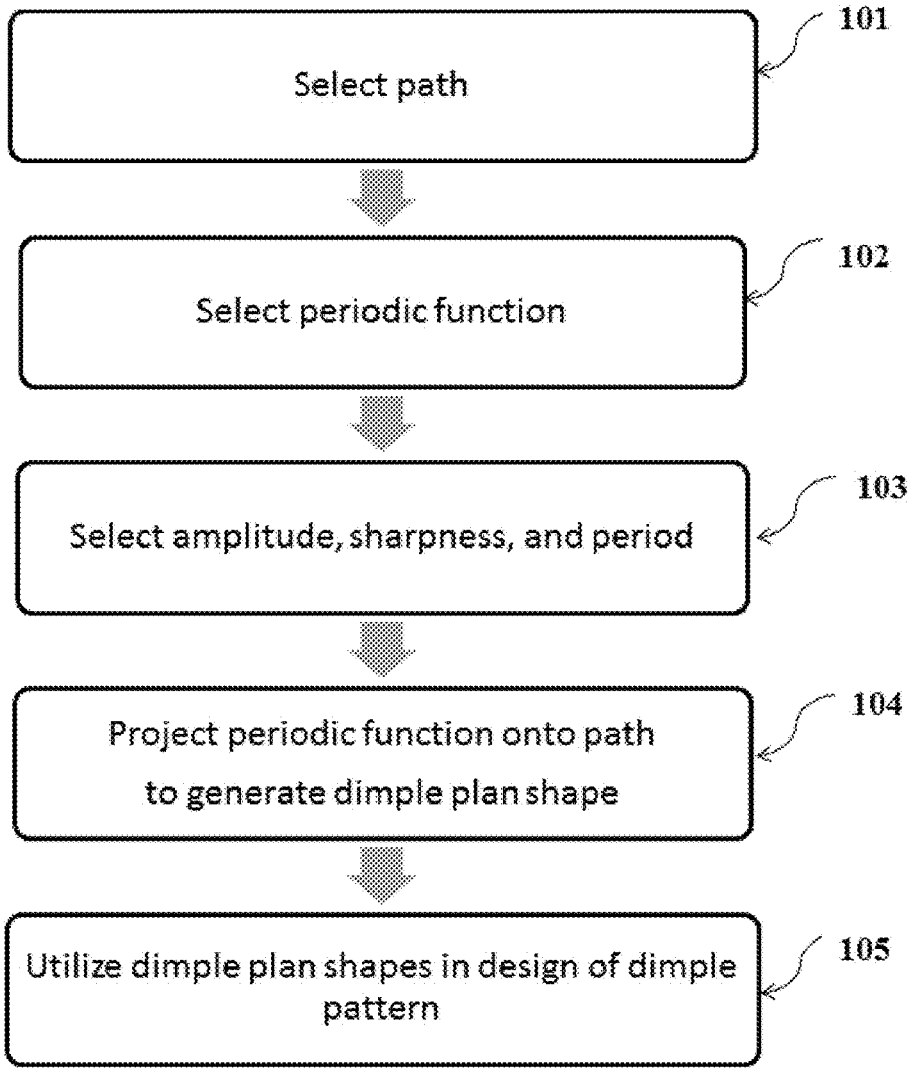
FIG. 6 is a flow chart illustrating the steps according to a method of the present invention.

FIG. 6 illustrates one embodiment of a method of forming a dimple plan shape in accordance with the present invention. For example, step 101 includes selecting the simple closed path on which the periodic function is to be projected. In this aspect, the present invention contemplates the use of any of the simple closed paths discussed above. Step 102 includes selecting the desired periodic function. Indeed, any of the periodic functions disclosed above are contemplated in this aspect of the invention.

At step 103, the amplitude, sharpness, period, or frequency of the periodic function is selected based on the desired periodic function and path. In one embodiment, the present invention contemplates dimple plan shapes defined by a low frequency, high amplitude periodic function. That is, the plan shapes of the present invention have a low period of oscillation (for example, a period, p, less than about 15) and an amplitude that leads to large values of $d_{max}$ (for example, greater than about 0.015 inches). Accordingly, the amplitude, sharpness, period, or frequency should be selected such that the values are in accordance with the parameters defined above.

At step 104, the variables selected above, including the path, periodic function, amplitude, sharpness, and period, are inserted into equation (6), reproduced below:

$$Q(x)=F_{path}(l,scl,x)*F_{periodic}(s,a,p,x) \tag{6}$$

The resultant function is then used to project the periodic function onto the simple closed path in order to generate the dimple plan shape. The resultant function will vary based on the desired path and periodic function. For example, if the desired periodic function is a cosine function, $F_{periodic}$ may be represented by equation (8), depicted below:

$$f(x)=s+a*\cos(p*\pi*x). \tag{8}$$

As discussed above, the resultant dimple plan shape (e.g., the resulting vector Q(x)) may also be used as the path to which another periodic function is mapped. For example, a periodic function having a different period or a different periodic function may be projected onto the resultant dimple plan shape to form a new dimple plan shape in accordance with the present invention.

After the dimple plan shape has been generated, at step 105, the plan shape can be used in designing geometries for dimple patterns of a golf ball. For example, the plan shape paths generated by the methods of the present invention can be imported into a CAD program and used to define dimple geometries and tool paths for fabricating tooling for golf ball manufacture. The various dimple geometries produced in accordance with the present invention can then be used in constructing a dimple pattern that maximizes interdigitation with neighboring dimples, which in turn leads to high surface coverage uniformity and improved dimple packing efficiency.

Degree of Interdigitation

The low frequency, high amplitude plan shapes described by the present invention produce dimple patterns having a high degree of interlockability or interdigitation of neighboring dimples. In this regard, the present invention is further directed to golf ball dimple patterns having a high degree of interlockability or interdigitation of neighboring dimples, thus producing dimple patterns with high packing efficiency and surface coverage. In particular, the interdigitation or interlockability of neighboring dimples in the dimple patterns according to the present invention (and golf balls made with such dimple patterns thereon) is quantifiable. Indeed, the dimple patterns according to this aspect of the present invention are associated with a parameter referred to as the Degree of Interdigitation (DOI). As described herein, the DOI is a value that quantifies the capability of the dimples of the present invention to interlock with each other when configured in a dimple pattern. According to the present invention, the DOI of each plan shape is based on the maximal radial distance of each dimple plan shape and the Dimple Penetration Coefficient of each neighboring dimple pair.

Figure 7:
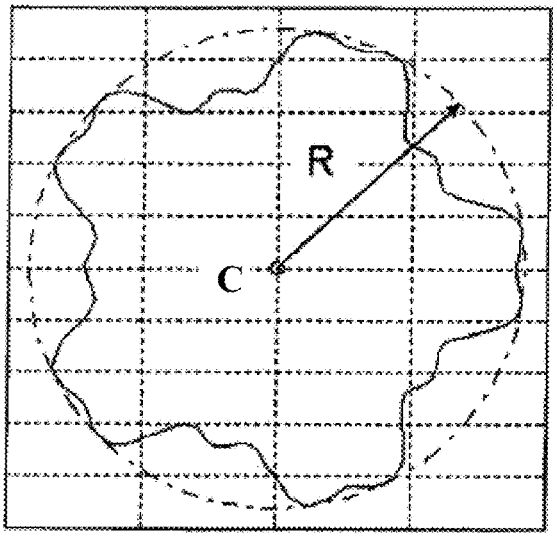
FIG. 7 illustrates a dimple plan shape produced in accordance with the present invention having a centroid and a maximal radial distance.

In determining the overall DOI, the maximal radial distance of each dimple plan shape is calculated. As shown in FIG. 7, the maximal radial distance, R, is the distance between the centroid, C, and any point on the plan shape. In one embodiment, the maximal radial distance is determined by rotating the dimple plan shape to the pole of the golf ball surface and then projecting the plan shape onto a plane located at the golf ball center with a normal parallel to a line running from the center of the golf ball through the pole. The centroid of the plan shape may then be calculated using the following equations:

$$x_{centroid} = \frac{1}{A}\int xdA \tag{9}$$

$$y_{centroid} = \frac{1}{A}\int ydA \tag{10}$$

where A is the area of the plan shape and ∫xdA and ∫ydA are the first moments of the area with respect to the y and x axes, respectively. Upon calculating the centroid of the plan shape, the maximum radial distance of any point on the plan shape from the centroid is determined according to the following equation:

$$R=\sqrt{(x_{plan}-x_{centroid})^2+(y_{plan}-y_{centroid})^2} \quad (11)$$

The present invention contemplates a maximal radial distance of about 0.050 inches to about 0.250 inches for each dimple plan shape. In another embodiment, the maximal radial distance is about 0.100 inches to about 0.220 inches for each dimple plan shape. In still another embodiment, the maximal radial distance is about 0.110 inches to about 0.200 inches for each dimple plan shape. In yet another embodiment, the maximal radial distance is about 0.120 inches to about 0.190 inches for each dimple plan shape.

After the maximal radial distance is determined for each dimple plan shape, the Dimple Penetration Coefficient (DPC) is calculated for each neighboring dimple pair. As described herein, the DPC may be determined by dividing the sum of the maximum radial distances of both neighboring dimples by the distance between the neighboring dimple three-dimensional centers on the golf ball surface and subtracting one.

Accordingly, to calculate the DPC, one must first determine all of the neighboring dimple pairs. For example, neighboring dimples may be determined by drawing two tangency lines from the center of the first dimple to a potential neighboring dimple. Then, a line segment is drawn connecting the center of the first dimple to the center of the potential neighboring dimple. If no line segment is intersected by another dimple or a portion of a dimple, then those dimples are considered neighboring dimples.

Figure 8:
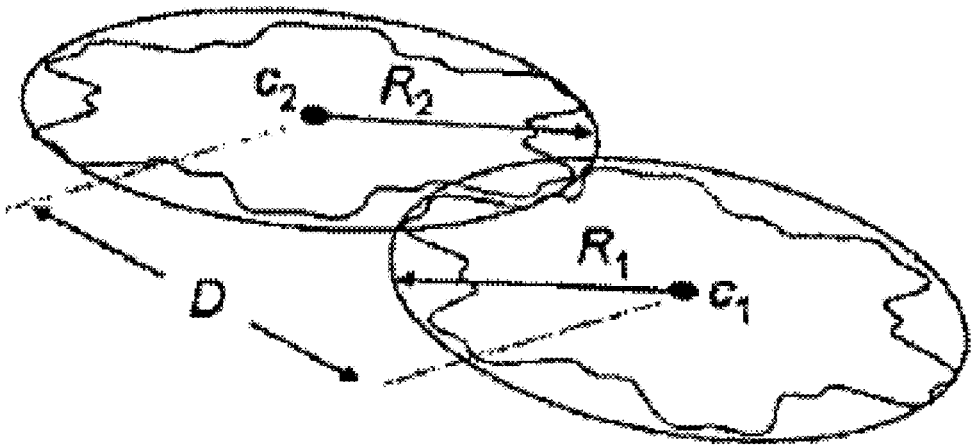
FIG. 8 illustrates a neighboring dimple pair produced in accordance with the present invention.

In this aspect, after the neighboring dimple pairs are determined, the distance between the dimple centers of each neighboring dimple pair may be calculated. For example, FIG. 8 shows a pair of neighboring dimples produced in accordance with the present invention having centers $C_1$ and $C_2$, respectively. The distance between center $C_1$ and center $C_2$ is represented by D. In one embodiment, the distance, D, may be calculated for each neighboring pair via the following equation:

$$D=\sqrt{(x_{c1}-x_{c2})^2+(y_{c1}-y_{c2})^2+(z_{c1}-z_{c2})^2} \quad (12).$$

As shown in Equation (12), the distance, D, is determined by taking the square root of the sum of the differences in center distances of a first neighboring dimple and a second neighboring dimple along the x, y, and z axes.

According to the present invention, after the distance between the dimple centers of a neighboring dimple pair is calculated, the DPC is calculated for each neighboring dimple pair. In one embodiment, the DPC is calculated by using the following equation:

$$DPC = \frac{R_1 + R_2}{D} - 1 \quad (13)$$

where $R_1$ is the maximum radial distance of the first neighboring dimple, $R_2$ is the maximum radial distance of the second neighboring dimple, and D is the distance between the neighboring dimple centers. The maximum radial distance, as described above, is the distance between the centroid of the dimple and any point on the plan shape. As shown in FIG. 8, the maximal radial distance of the first neighboring dimple, $R_1$, represents the distance between the centroid, $C_1$, and any point on the plan shape of the first neighboring dimple projected to the golf ball surface. The maximal radial distance of the second neighboring dimple, $R_2$, represents the distance between the centroid, $C_2$, and any point on the plan shape of the second neighboring dimple projected to the golf ball surface.

The present invention contemplates DPC values ranging from about 0.5 to about −0.1. In another embodiment, the DPC value for each neighboring dimple pair ranges from about 0.3 to about −0.05. In still another embodiment, the DPC value for each neighboring dimple pair ranges from about 0.1 to about −0.02. In yet another embodiment, the DPC value for each neighboring dimple pair ranges from about 0.05 to about 0. As will be appreciated by those of ordinary skill in the art, positive values for the DPC indicate a greater degree of interdigitation between neighboring dimple pairs, while negative values for the DPC indicate no interdigitation.

After the DPC is calculated for the neighboring dimple pair, the Degree of Interdigitation (DOI) may be calculated. As described above, the DOI is a parameter for quantifying the measure of interlockability of neighboring dimples produced in accordance with the present invention. In one embodiment, the DOI is calculated according to the following equation:

$$DOI = \frac{1}{n}\sum_{k=1}^{n} DPC_k \quad (14)$$

where n is the number of possible neighboring dimple pairs and $DPC_k$ is the individual dimple penetration coefficient for each neighboring dimple pair.

In this aspect, the present invention contemplates dimple plan shapes and dimple patterns having DOI values less than 0.50 and greater than zero. In one embodiment, the dimple plan shapes and dimple patterns of the present invention have DOI values ranging from about 0.01 to about 0.40. In another embodiment, the dimple plan shapes and dimple patterns of the present invention have DOI values ranging from about 0.05 to about 0.30. In still another embodiment, the dimple plan shapes and dimple patterns of the present invention have DOI values ranging from about 0.10 to about 0.20. Without being bound by any particular theory, the high degree of dimple interdigitation created by the present invention minimizes land area spacing and gives a more uniform distribution of surface coverage for improved aerodynamic symmetry.

The foregoing procedure may be repeated for any dimple pair on the ball. However, as one of ordinary skill in the art would readily understand, golf balls formed according to the present invention include at least about 10 percent or more of dimples having a plan shape defined by low frequency, high amplitude periodic functions and a DOI value greater than zero. In another embodiment, the golf balls formed according to the present invention include at least about 25 percent or more of dimples having a plan shape defined by low frequency, high amplitude periodic functions and a DOI value greater than zero. In still another embodiment, the golf balls formed according to the present invention include at least about 50 percent or more of dimples having a plan shape defined by low frequency, high amplitude periodic functions and a DOI value greater than zero.

Dimple Patterns & Packing

The present invention allows for improved dimple packing over previous patterns so that a greater percentage of the surface of the golf ball is covered by dimples. In particular, due to the high degree of interlockability or interdigitation of neighboring dimples, each dimple having a plan shape in accordance with the present invention is part of a dimple pattern that maximizes surface coverage uniformity and packing efficiency.

In one embodiment, the dimple pattern provides greater than about 80 percent surface coverage. In another embodiment, the dimple pattern provides greater than about 85 percent surface coverage. In yet another embodiment, the dimple pattern provides greater than about 90 percent surface coverage. In still another embodiment, the dimple pattern provides greater than about 92 percent surface coverage.

In this aspect, the golf ball dimple plan shapes of the present invention can be tailored to maximize surface coverage uniformity and packing efficiency by selecting a period for the periodic function that is a scalar multiple of the number of neighboring dimples. For example, if the number of neighboring dimples is 4, the present invention contemplates a dimple plan shape having a period of 8 or 12. In another embodiment, the period is equal to the number of neighboring dimples. For example, if the dimple plan shape is constructed using a period of 5, the present invention contemplates that the dimple will be surrounded by 5 neighboring dimples.

Figure 15:
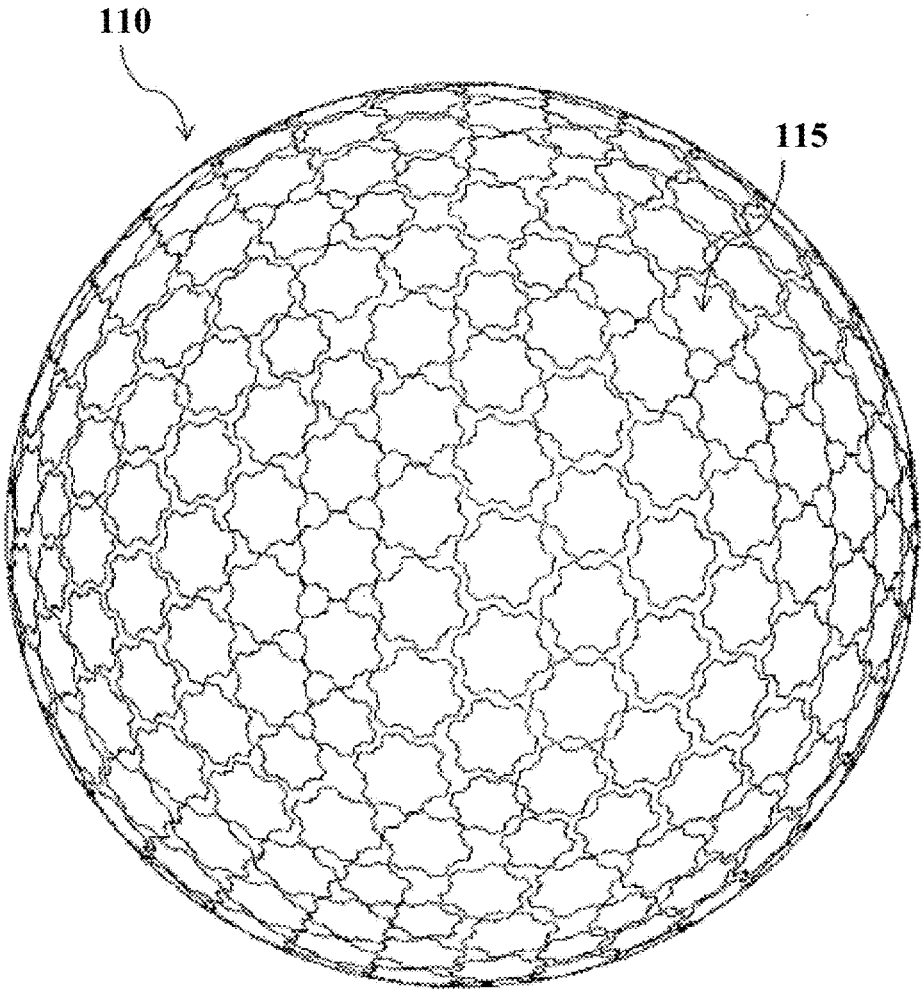
FIG. 15 illustrates a golf ball dimple pattern constructed from a plurality of dimple plan shapes according to the present invention.

FIG. 15 illustrates an example of a dimple pattern created in accordance with the present invention. In particular, FIG. 15 illustrates a golf ball dimple pattern 110 made up of dimple plan shapes (represented by 115) defined by low frequency, high amplitude periodic functions and produced in accordance with the present invention. As shown in FIG. 15, the plan shapes 115 are formed using a square wave function mapped along a circular path with period (p) of 6, sharpness factor (s) of 10, and amplitude (a) of 1. In this embodiment, the dimple pattern 110 is further defined to have a DOI of about 0.018. As can be seen by FIG. 15, the high degree of interlockability or interdigitation of the dimple plan shapes 115 allows for a dimple pattern 110 that maximizes surface coverage uniformity and packing efficiency.

While the plan shapes of the present invention may be used for at least a portion of the dimples on a golf ball, it is not necessary that the plan shapes be used on every dimple of a golf ball. In general, it is preferred that a sufficient number of dimples on the ball have plan shapes according to the present invention so that the aerodynamic characteristics of the ball may be altered and the packing efficiency benefits realized. For example, at least about 30 percent of the dimples on a golf ball include plan shapes according to the present invention. In another embodiment, at least about 50 percent of the dimples on a golf ball include plan shapes according to the present invention. In still another embodiment, at least about 70 percent of the dimples on a golf ball include plan shapes according to the present invention. In yet another embodiment, at least about 90 percent of the dimples on a golf ball include the plan shapes of the present invention. In still another embodiment, all of the dimples (100 percent) on a golf ball may include the plan shapes of the present invention.

While the present invention is not limited by any particular dimple pattern, dimples having plan shapes according to the present invention are arranged preferably along parting lines or equatorial lines, in proximity to the poles, or along the outlines of a geodesic or polyhedron pattern. Conventional dimples, or those dimples that do not include the plan shapes of the present invention, may occupy the remaining spaces. The reverse arrangement is also suitable. Suitable dimple patterns include, but are not limited to, polyhedron-based patterns (e.g., icosahedron, octahedron, dodecahedron, icosidodecahedron, cuboctahedron, and triangular dipyramid), phyllotaxis-based patterns, spherical tiling patterns, and random arrangements.

Dimple Dimensions

The dimples on the golf balls of the present invention may include any width, depth, depth profile, edge angle, or edge radius and the patterns may include multitudes of dimples having different widths, depths, depth profiles, edge angles, or edge radii.

Since the plan shape perimeters of the present invention are noncircular, the plan shapes are defined by an effective dimple diameter which is twice the average radial dimension of the set of points defining the plan shape from the plan shape centroid. For example, in one embodiment, dimples according to the present invention have an effective dimple diameter within a range of about 0.05 inches to about 0.300 inches. In another embodiment, the dimples have an effective dimple diameter of about 0.080 inches to about 0.250 inches. In still another embodiment, the dimples have an effective dimple diameter of about 0.100 inches to about 0.225 inches. In yet another embodiment, the dimples have an effective dimple diameter of about 0.125 inches to about 0.200 inches.

The surface depth for dimples of the present invention is within a range of about 0.003 inches to about 0.025 inches. In one embodiment, the surface depth is about 0.005 inches to about 0.020 inches. In another embodiment, the surface depth is about 0.006 inches to about 0.017 inches.

The dimples of the present invention also have a plan shape area. By the term, "plan shape area," it is meant the area based on a planar view of the dimple plan shape, such that the viewing plane is normal to an axis connecting the center of the golf ball to the point of the calculated surface depth. In one embodiment, dimples of the present invention have a plan shape area ranging from about 0.0025 $in^2$ to about 0.045 $in^2$. In another embodiment, dimples of the present invention have a plan shape area ranging from about 0.005 $in^2$ to about 0.035 $in^2$. In still another embodiment, dimples of the present invention have a plan shape area ranging from about 0.010 $in^2$ to about 0.030 $in^2$.

Figure 9:
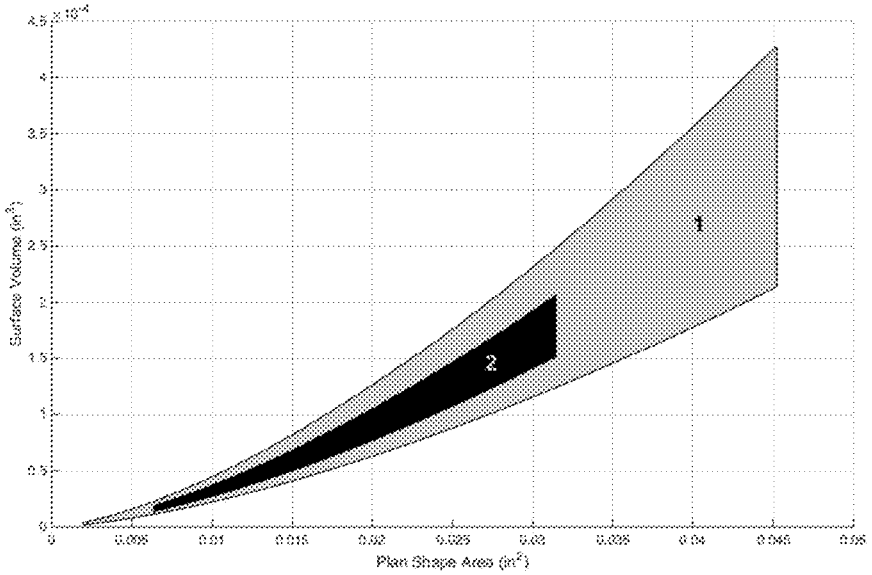
FIG. 9 is a graphical representation illustrating dimple surface volumes for golf balls produced in accordance with the present invention.
Figure 10:
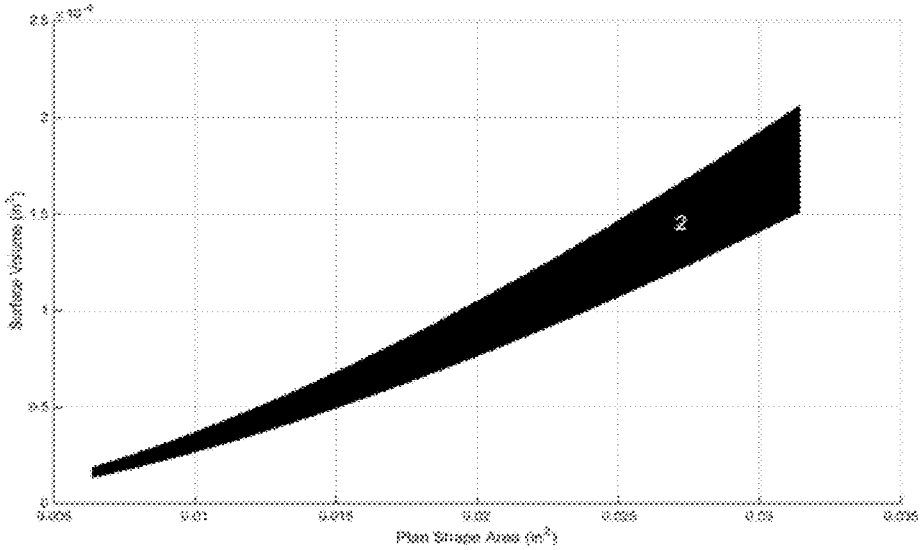
FIG. 10 is a graphical representation illustrating preferred dimple surface volumes for golf balls produced in accordance with the present invention.

Further, dimples of the present invention have a dimple surface volume. By the term, "dimple surface volume," it is meant the total volume encompassed by the dimple shape and the surface of the golf ball. FIGS. 9 and 10 illustrate graphical representations of dimple surface volumes contemplated for dimples produced in accordance with the present invention. For example, FIGS. 9 and 10 demonstrate contemplated dimple surface volumes over a range of plan shape areas. In one embodiment, dimples produced in accordance with the present invention have a plan shape area and dimple surface volume falling within the ranges shown in FIG. 9. For example, a dimple having a plan shape area of about 0.01 $in^2$ may have a surface volume of about $0.20\times10^{-4}$ $in^3$ to about $0.50\times10^{-4}$ $in^3$. In another embodiment, a dimple having a plan shape area of about 0.025 $in^2$ may have a surface volume of about $0.80\times10^{-4}$ $in^3$ to about $1.75\times10^{-4}$ $in^3$. In still another embodiment, a dimple having a plan shape area of about 0.030 $in^2$ may have a surface volume of about $1.20\times10^{-4}$ $in^3$ to about $2.40\times10^{-4}$ $in^3$. In yet another embodiment, a dimple having a plan shape area of about 0.045 $in^2$ may have a surface volume of about $2.10\times10^{-4}$ $in^3$ to about $4.25\times10^{-4}$ $in^3$.

In another embodiment, dimples produced in accordance with the present invention have a plan shape area and dimple surface volume falling within the ranges shown in FIG. 10. For example, a dimple having a plan shape area of about 0.01 $in^2$ may have a surface volume of about $0.25\times10^{-4}$ $in^3$ to about $0.35\times10^{-4}$ $in^3$. In another embodiment, a dimple having a plan shape area of about 0.025 $in^2$ may have a surface volume of about $1.10\times10^{-4}$ $in^3$ to about $1.45\times10^{-4}$ $in^3$. In yet another embodiment, a dimple having a plan shape area of about 0.030 $in^2$ may have a surface volume of about $1.40\times10^{-4}$ $in^3$ to about $1.90\times10^{-4}$ $in^3$.

Since, as discussed above, the dimple patterns useful in accordance with the present invention do not necessarily include only dimples having plan shapes as described above, other conventional dimples included in the dimple patterns may have similar dimensions.

Dimple Profile

In addition to varying the size of the dimples, the cross-sectional profile of the dimples may be varied. The cross-sectional profile of the dimples according to the present invention may be based on any known dimple profile shape. In one embodiment, the profile of the dimples corresponds to a curve. For example, the dimples of the present invention may be defined by the revolution of a catenary curve about an axis, such as that disclosed in U.S. Pat. Nos. 6,796,912 and 6,729,976, the entire disclosures of which are incorporated by reference herein. In another embodiment, the dimple profiles correspond to polynomial curves, ellipses, spherical curves, saucer-shapes, truncated cones, trigonometric, exponential, or logarithmic curves, and flattened trapezoids. For example, the dimple profile may be defined by a conical shape, such as that disclosed in U.S. Pat. No. 8,632,426, the entire disclosure of which is incorporated by reference herein.

The profile of the dimple may also aid in the design of the aerodynamics of the golf ball. For example, shallow dimple depths, such as those in U.S. Pat. No. 5,566,943, the entire disclosure of which is incorporated by reference herein, may be used to obtain a golf ball with high lift and low drag coefficients. Conversely, a relatively deep dimple depth may aid in obtaining a golf ball with low lift and low drag coefficients.

The dimple profile may also be defined by combining a spherical curve and a different curve, such as a cosine curve, a frequency curve or a catenary curve, as disclosed in U.S. Patent Publication No. 2012/0165130, which is incorporated in its entirety by reference herein. Similarly, the dimple profile may be defined by a combination of two or more curves. For example, in one embodiment, the dimple profile is defined by combining a spherical curve and a different curve. In another embodiment, the dimple profile is defined by combining a cosine curve and a different curve. In still another embodiment, the dimple profile is defined by combining a frequency curve and a different curve. In yet another embodiment, the dimple profile is defined by combining a catenary curve and different curve. In still another embodiment, the dimple profile may be defined by combining three or more different curves. In yet another embodiment, one or more of the curves may be a functionally weighted curve, as disclosed in U.S. Patent Publication No. 2013/0172123, which is incorporated in its entirety by reference herein.

Dimple cross-sectional profiles have two edge angles ($\Phi_{EDGE}$), one at each of the two ends of the profile where the profile meets the dimple perimeter. As a result of having a plan shape defined by mapping a periodic function along a simple closed path, a dimple of the present invention has at least two cross-sectional profiles wherein at least one edge angle of one profile is different from at least one edge angle of another profile. Further, depending on the period p, a single cross-sectional profile of a dimple of the present invention may have an edge angle on one side of the cross-sectional profile that is different from the edge angle on the other side of the same cross-sectional profile. Thus, each dimple of the present invention comprises at least a first dimple profile having a first edge angle ($\Phi_{EDGE1}$) and a second edge angle ($\Phi_{EDGE2}$) and a second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values. Preferably, at least two of $\Phi_{EDGE1}$, $\Phi_{EDGE2}$, $\Phi_{EDGE3}$ and $\Phi_{EDGE4}$ have values that differ by 0.5° to 6.0°, or values that differ by 1.0° to 6.0°. In a particular embodiment, one of the following is true:

a) $\Phi_{EDGE1}=\Phi_{EDGE2}$, $\Phi_{EDGE3}=\Phi_{EDGE4}$, and $\Phi_{EDGE1}\neq\Phi_{EDGE3}$;

b) $\Phi_{EDGE1}\neq\Phi_{EDGE2}$, $\Phi_{EDGE3}=\Phi_{EDGE4}$, and $\Phi_{EDGE1}=\Phi_{EDGE3}$;

c) $\Phi_{EDGE1}\neq\Phi_{EDGE2}$, $\Phi_{EDGE3}=\Phi_{EDGE4}$, and $\Phi_{EDGE1}\neq\Phi_{EDGE3}$;

d) $\Phi_{EDGE1}\neq\Phi_{EDGE2}$; $\Phi_{EDGE3}\neq\Phi_{EDGE4}$, $\Phi_{EDGE1}=\Phi_{EDGE3}$, and $\Phi_{EDGE2}\neq\Phi_{EDGE4}$, or e) $\Phi_{EDGE1}\neq\Phi_{EDGE2}$; $\Phi_{EDGE3}\neq\Phi_{EDGE4}$, $\Phi_{EDGE1}\neq\Phi_{EDGE3}$, and $\Phi_{EDGE2}\neq\Phi_{EDGE4}$.

Depending on the frequency and amplitude of the periodic function defining the dimple plan shape, a dimple of the present invention may include an infinite number of different edge angle values. For purposes of the present invention, edge angles are generally considered to be the same if they differ by less than 0.25°. It should be understood that manufacturing variances are to be taken into account when determining whether two differently located edge angles have the same value. The location of the edge angle along the dimple perimeter shape should also be taken into account. Preferably, the edge angles of a dimple of the present invention that do not have the same value differ by 0.5° to 6.0°, or differ by 1.0° to 6.0°.

In a particular embodiment, the average of the edge angles of all of the dimple profiles of a single dimple of the present invention is from 11° to 16°.

In another particular embodiment, the difference between the maximum edge angle and the average of the edge angles of all of the dimple profiles of a single dimple of the present invention is 3.00° or less.

In another particular embodiment, the difference between the minimum edge angle and the average of the edge angles of all of the dimple profiles of a single dimple of the present invention is 3.00° or less.

Figure 16:
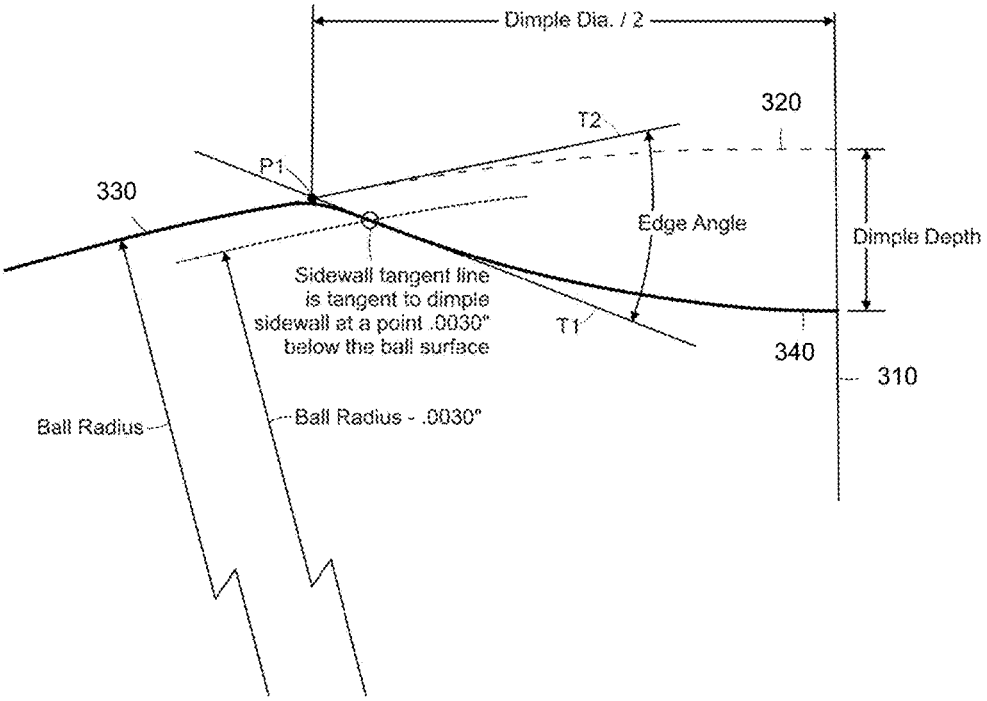
FIG. 16 is a schematic diagram illustrating a method for measuring the edge angle of a dimple.

For purposes of the present disclosure, edge angle measurements are determined on finished golf balls. Generally, it may be difficult to measure an edge angle due to the indistinct nature of the boundary dividing the dimple from the ball's undisturbed land surface. Due to the effect of coatings on the golf ball surface and/or the dimple design itself, the junction between the land surface and the dimple is typically not a sharp corner and is therefore indistinct. This can make the measurement of properties such as edge angle ($\Phi_{EDGE}$) and dimple diameter, somewhat ambiguous. To resolve this problem, edge angle ($\Phi_{EDGE}$) on a finished golf ball is measured as follows, in reference to FIG. 16. FIG. 16 shows a dimple half-profile extending from the dimple centerline 310 to the ball's undisturbed land surface 330. A ball phantom surface 320 is constructed above the dimple as a continuation of the land surface 330. A first tangent line T1 is then constructed at a point on the dimple sidewall that is spaced 0.003 inches radially inward from the phantom surface 320. T1 intersects phantom surface 320 at a point P1, which defines a nominal dimple edge position. A second tangent line T2 is then constructed, tangent to the phantom surface 320, at P1. The edge angle ($\Phi_{EDGE}$) is the angle between T1 and T2. The dimple diameter is the distance between P1 and its equivalent point at the opposite end of the dimple profile. The dimple depth is the distance measured along a ball radius from the phantom surface of the ball to the deepest point on the dimple. The dimple surface volume is the space enclosed between the phantom surface 320 and the dimple surface 340 (extended along T1 until it intersects the phantom surface).

Golf Ball Construction

The dimples of the present invention may be used with practically any type of ball construction. For instance, the golf ball may have a two-piece design, a double cover, or veneer cover construction depending on the type of performance desired of the ball. Other suitable golf ball constructions include solid, wound, liquid-filled, and/or dual cores, and multiple intermediate layers.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

EXAMPLES

The following non-limiting examples demonstrate plan shapes of golf ball dimples made in accordance with the present invention. The examples are merely illustrative of the preferred embodiments of the present invention, and are not to be construed as limiting the invention, the scope of which is defined by the appended claims.

Example 1

The following example illustrates golf ball dimple plan shapes defined by a low frequency, high amplitude sawtooth wave periodic function mapped to a circular path. Table 2, depicted below, describes the mathematical parameters used to project the periodic function onto the simple closed path.

TABLE 2

| PLAN SHAPE PARAMETERS OF EXAMPLE 1 | |
|---|---|
| Path | Circular |
| Periodic Function Function (f(x)) | Sawtooth Wave (2-term Fourier expansion) General Fourier Series: $f(x) = s + \frac{a}{\pi}\sum_{k=1}^{\infty}\frac{\sin(k\pi px)}{k}$ |

TABLE 2-continued

| PLAN SHAPE PARAMETERS OF EXAMPLE 1 | |
|---|---|
| Path | Circular |
| | 2-term Fourier Expansion: $f(x) = s + \frac{a}{\pi}\left(\sin(\pi px) + \frac{\sin(2\pi px)}{2}\right)$ |
| Sharpness Factor, s | about 5 |
| Amplitude, a | about 1 |

Figure 11A:
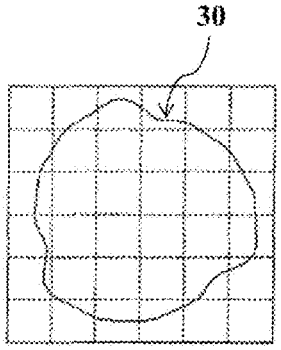
FIGS. 11A-11F illustrate various embodiments of a golf ball dimple plan shape defined by a sawtooth wave periodic function along a circular path.
Figure 11B:
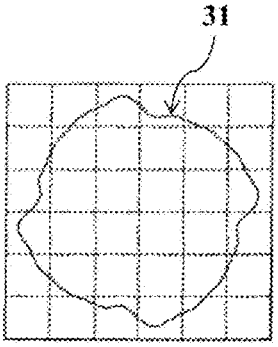
Figure 11C:
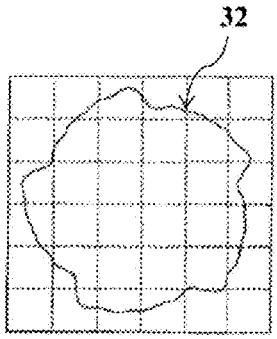
Figure 11D:
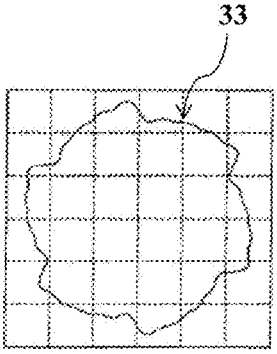
Figure 11E:
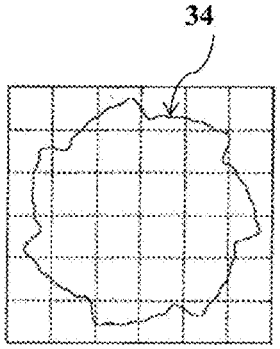
Figure 11F:
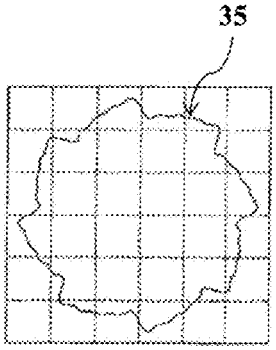

FIGS. 11A-11F demonstrate the golf ball dimple plan shapes produced in accordance with the parameters of Table 2. Specifically, FIG. 11A shows a dimple plan shape 30 defined by a sawtooth wave function approximated by a two-term Fourier series having period, p=3, mapped to a circular path. FIG. 11B shows a dimple plan shape 31 defined by a sawtooth wave function approximated by a two-term Fourier series having period, p=4, mapped to a circular path. FIG. 11C shows a dimple plan shape 32 defined by a sawtooth wave function approximated by a two-term Fourier series having period, p=5, mapped to a circular path. FIG. 11D shows a dimple plan shape 33 defined by a sawtooth wave function approximated by a two-term Fourier series having period, p=6, mapped to a circular path. FIG. 11E shows a dimple plan shape 34 defined by a sawtooth wave function approximated by a two-term Fourier series having period, p=7, mapped to a circular path. FIG. 11F shows a dimple plan shape 35 defined by a sawtooth wave function approximated by a two-term Fourier series having period, p=8, mapped to a circular path.

Example 2

The following example illustrates golf ball dimple plan shapes defined by a low frequency, high amplitude square wave periodic function mapped to a circular path. Table 3, depicted below, describes the mathematical parameters used to project the periodic function onto the simple closed path.

TABLE 3

| PLAN SHAPE PARAMETERS OF EXAMPLE 2 | |
|---|---|
| Path | Circular |
| Periodic Function Function (f(x)) | Square Wave (4-term Fourier expansion) General Fourier Series: $f(x) = s + \frac{a}{\pi}\sum_{k=1,3,5\ldots}^{\infty}\frac{\sin(k\pi px)}{k}$ 4-term Fourier Expansion: $f(x) = s + \frac{a}{\pi}\left(\sin(\pi px) + \frac{\sin(3\pi px)}{3} + \frac{\sin(5\pi px)}{5} + \frac{\sin(7\pi px)}{7}\right)$ |
| Sharpness Factor, s | about 8 |
| Amplitude, a | about 1 |

Figure 12A:
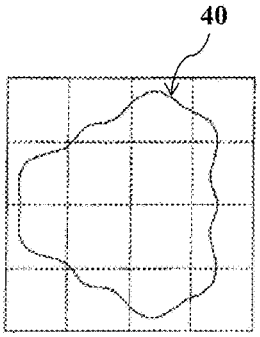
FIGS. 12A-12F illustrate various embodiments of a golf ball dimple plan shape defined by a square wave periodic function along a circular path.
Figure 12B:
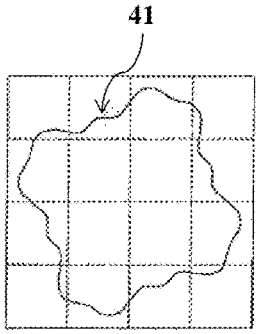
Figure 12C:
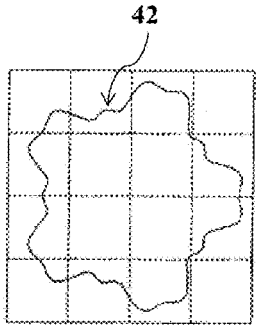
Figure 12D:
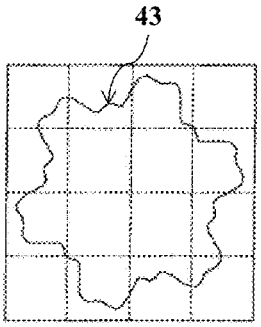
Figure 12E:
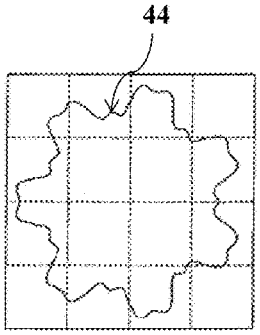
Figure 12F:
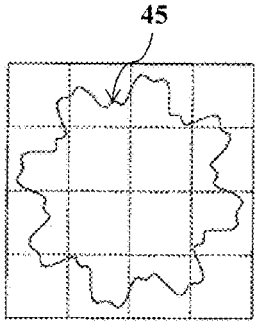

FIGS. 12A-12F demonstrate the golf ball dimple plan shapes produced in accordance with the parameters of Table 3. In particular, FIG. 12A shows a dimple plan shape 40 defined by a square wave function approximated by a four-term Fourier series having period, p=3, mapped to a circular path. FIG. 12B shows a dimple plan shape 41 defined by a square wave function approximated by a four-term Fourier series having period, p=4, mapped to a circular path. FIG. 12C shows a dimple plan shape 42 defined by a square wave function approximated by a four-term Fourier series having period, p=5, mapped to a circular path. FIG. 12D shows a dimple plan shape 43 defined by a square wave function approximated by a four-term Fourier series having period, p=6, mapped to a circular path. FIG. 12E shows a dimple plan shape 44 defined by a square wave function approximated by a four-term Fourier series having period, p=7, mapped to a circular path. FIG. 12F shows a dimple plan shape 45 defined by a square wave function approximated by a four-term Fourier series having period, p=8, mapped to a circular path.

Example 3

The following example illustrates golf ball dimple plan shapes defined by a low frequency, high amplitude arbitrary periodic function mapped to a circular path. Table 4, depicted below, describes the mathematical parameters used to project the periodic function onto the simple closed path.

TABLE 4

| PLAN SHAPE PARAMETERS OF EXAMPLE 3 | |
|---|---|
| Path | Arbitrary |
| Periodic Function | Arbitrary |
| Function (f(x)) | $f(x) = s + a\left(\cos(\pi px)^3 * \sin(\pi px) + \frac{\sin(7\pi px)}{7}\right)$ |
| Sharpness Factor, s | about 8 |
| Amplitude, a | about 2 |

Figure 13A:
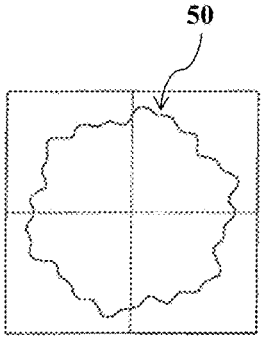
FIGS. 13A-13F illustrate various embodiments of a golf ball dimple plan shape defined by an arbitrary periodic function along a circular path.
Figure 13B:
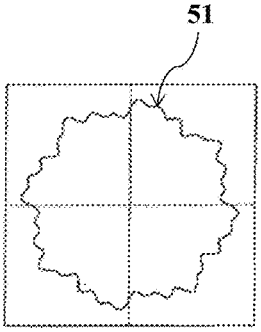
Figure 13C:
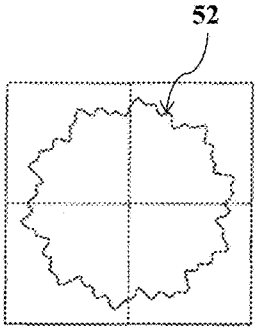
Figure 13D:
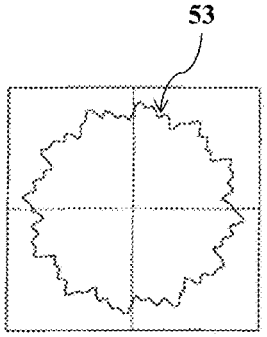
Figure 13E:
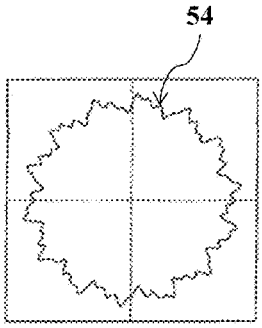
Figure 13F:
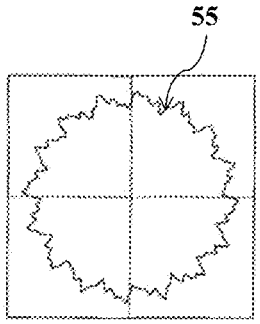

FIGS. 13A-13F demonstrate the golf ball dimple plan shapes produced in accordance with the parameters of Table 4. In particular, FIG. 13A shows a dimple plan shape 50 defined by an arbitrary periodic function having period, p=3, mapped to a circular path. FIG. 13B shows a dimple plan shape 51 defined by an arbitrary periodic function having period, p=4, mapped to a circular path. FIG. 13C shows a dimple plan shape 52 defined by an arbitrary periodic function having period, p=5, mapped to a circular path. FIG. 13D shows a dimple plan shape 53 defined by an arbitrary periodic function having period, p=6, mapped to a circular path. FIG. 13E shows a dimple plan shape 54 defined by an arbitrary periodic function having period, p=7, mapped to a circular path. FIG. 13F shows a dimple plan shape 55 defined by an arbitrary periodic function having period, p=8, mapped to a circular path.

Example 4

The following example illustrates golf ball dimple plan shapes defined by a low frequency, high amplitude arbitrary periodic function mapped to an arbitrary path. Table 5, depicted below, describes the mathematical parameters used to project the periodic function onto the simple closed path.

TABLE 5

| PLAN SHAPE PARAMETERS OF EXAMPLE 4 | |
|---|---|
| Path | Arbitrary |
| Periodic Function | Arbitrary |
| Function (f(x)) | $f(x) = s + a\,(\cos(\pi px) * \sin(\pi px)^2 - \mathrm{abs}(\sin(\pi px)))$ |
| Sharpness Factor, s | about 8 |
| Amplitude, a | about 0.727 |

Figure 14A:
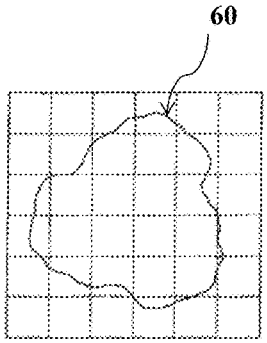
FIGS. 14A-14F illustrate various embodiments of a golf ball dimple plan shape defined by an arbitrary periodic function along an arbitrary path.
Figure 14B:
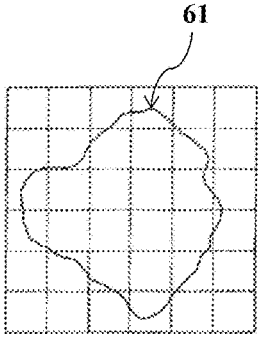
Figure 14C:
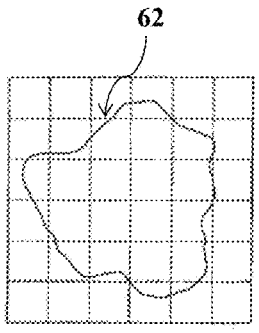
Figure 14D:
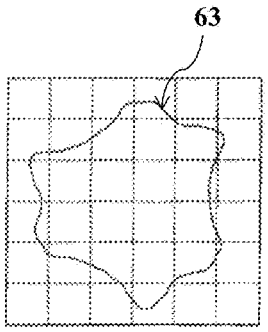
Figure 14E:
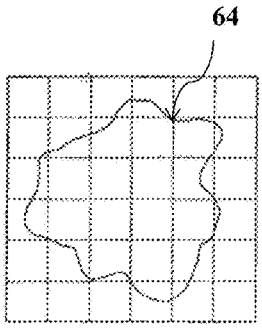
Figure 14F:
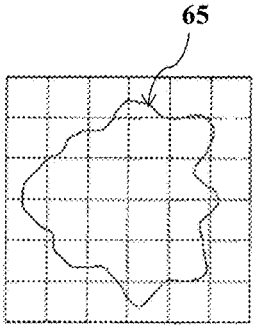

FIGS. 14A-14F demonstrate the golf ball dimple plan shapes produced in accordance with the parameters of Table 9. In particular, FIG. 14A shows a dimple plan shape 60 defined by an arbitrary periodic function having period, p=3, mapped to an arbitrary path. FIG. 14B shows a dimple plan shape 61 defined by an arbitrary periodic function having period, p=4, mapped to an arbitrary path. FIG. 14C shows a dimple plan shape 62 defined by an arbitrary periodic function having period, p=5, mapped to an arbitrary path. FIG. 14D shows a dimple plan shape 63 defined by an arbitrary periodic function having period, p=6, mapped to an arbitrary path. FIG. 14E shows a dimple plan shape 64 defined by an arbitrary periodic function having period, p=7, mapped to an arbitrary path. FIG. 14F shows a dimple plan shape 65 defined by an arbitrary periodic function having period, p=8, mapped to an arbitrary path.

Example 5

The following example illustrates golf ball dimple plan shapes defined by a low frequency, high amplitude square wave function mapped to a circular path. The square wave function is approximated by a four-term Fourier series. Table 6 below describes the mathematical parameters used to project the periodic square wave function onto the simple closed path.

TABLE 6

| PLAN SHAPE PARAMETERS OF EXAMPLE 5 | |
|---|---|
| Path | Circular |
| Periodic Function | Square Wave (4-term Fourier expansion) |
| Function (f(x)) | General Fourier Series: $f(x) = s + \frac{a}{\pi}\sum_{k=1,3,5\ldots}^{\infty}\frac{\sin(k\pi px)}{k}$ 4-term Fourier Expansion: $f(x) = s + \frac{a}{\pi}\left(\sin(\pi px) + \frac{\sin(3\pi px)}{3} + \frac{\sin(5\pi px)}{5} + \frac{\sin(7\pi px)}{7}\right)$ |
| Sharpness Factor, s | 8 |
| Amplitude, a | 1 |
| Period, p | 6 |

Figure 17A:
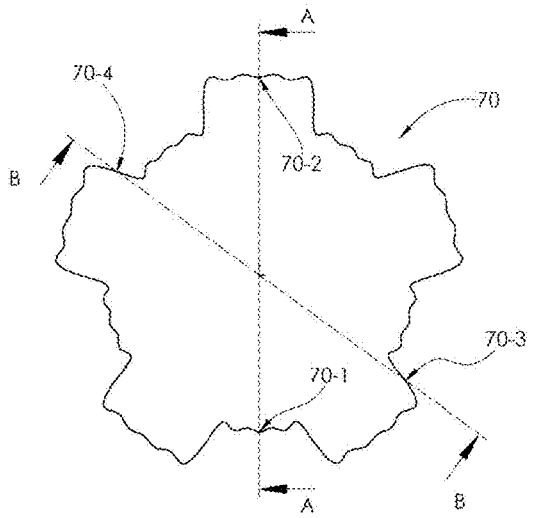
FIG. 17A illustrates a golf ball dimple plan shape defined by a periodic square wave function mapped along a circular path in accordance with an embodiment of the present invention.
Figure 17B:
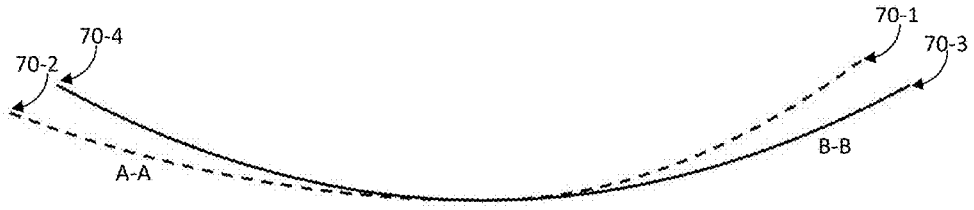
FIG. 17B illustrates two dimple profiles of a dimple having the plan shape shown in FIG. 17A in accordance with an embodiment of the present invention.

FIG. 17A illustrates a golf ball dimple plan shape 70 produced in accordance with the parameters of Table 6 and having a 0.175 inch nominal dimple diameter. FIG. 17B illustrates profiles A-A (dashed line) and B-B (solid line), which are cross-sectional profiles of the dimple at the locations indicated in FIG. 17A. Profiles A-A and B-B are defined by the polynomial function $y=x^2$. Profile A-A has two ends 70-1 and 70-2 where profile A-A meets the dimple perimeter. Profile A-A has an edge angle, $\Phi_{EDGE1}$, at end 70-1, and an edge angle, $\Phi_{EDGE2}$, at end 70-2. Profile B-B has two ends 70-3 and 70-4 wherein profile B-B meets the dimple perimeter. Profile B-B has an edge angle, $\Phi_{EDGE3}$, at end 70-3, and an edge angle, $\Phi_{EDGE4}$, at end 70-4. In this example, $\Phi_{EDGE1}$ is about 11.00°, $\Phi_{EDGE2}$ is about 8.90°, $\Phi_{EDGE3}$ is about 9.85, and $\Phi_{EDGE4}$ is about 9.85. Thus, in this example: $\Phi_{EDGE1}\neq\Phi_{EDGE2}$, $\Phi_{EDGE3}=\Phi_{EDGE4}$, $\Phi_{EDGE1}\neq\Phi_{EDGE3}$, and $\Phi_{EDGE2}\neq\Phi_{EDGE3}$.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A golf ball having a generally spherical surface and comprising a plurality of dimples on the spherical surface, wherein at least a portion of the plurality of dimples have a non-circular plan shape defined by a low frequency periodic function mapped along a simple closed path according to the following function:

$$Q(x)=F_{path}(l,scl,x)*F_{periodic}(s,a,p,x)$$

where $F_{path}$ is a circle, ellipse, or square of length l, with scale factor scl, defined along the vertices x, and $F_{periodic}$ is a low frequency periodic function with sharpness factor s, amplitude a, and period p defined at the vertices x, and period p is about 15 or less;

wherein the maximum absolute distance of any point on the plan shape from the simple closed path is about 0.015 inches to about 0.050 inches; and wherein each one of the dimples having a non-circular plan shape defined by a low frequency periodic function mapped along a simple closed path comprises a first dimple profile and a second dimple profile, the first dimple profile having a first edge angle ($\Phi_{EDGE1}$) and a second edge angle ($\Phi_{EDGE2}$) and the second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values.

2. The golf ball of claim 1, wherein at least two of $\Phi_{EDGE1}$, $\Phi_{EDGE2}$, $\Phi_{EDGE3}$ and $\Phi_{EDGE4}$ have values that differ by 1.0° to 6.0°.

3. The golf ball of claim 1, wherein:

$\Phi_{EDGE1}=\Phi_{EDGE2}$, $\Phi_{EDGE3}=\Phi_{EDGE4}$, and $\Phi_{EDGE1}\neq\Phi_{EDGE3}$.

4. The golf ball of claim 1, wherein:

$\Phi_{EDGE1}\neq\Phi_{EDGE2}$, $\Phi_{EDGE3}=\Phi_{EDGE4}$.

5. The golf ball of claim 4, wherein $\Phi_{EDGE1}=\Phi_{EDGE3}$.

6. The golf ball of claim 4, wherein $\Phi_{EDGE1}\neq\Phi_{EDGE3}$.

7. The golf ball of claim 6, wherein $\Phi_{EDGE2}\neq\Phi_{EDGE3}$.

8. The golf ball of claim 1, wherein:

$\Phi_{EDGE1}\neq\Phi_{EDGE}2$, $\Phi_{EDGE3}\neq\Phi_{EDGE4}$, $\Phi_{EDGE1}=\Phi_{EDGE3}$, and $\Phi_{EDGE2}\neq\Phi_{EDGE4}$.

9. The golf ball of claim 1, wherein:

$\Phi_{EDGE1}\neq\Phi_{EDGE2}$, $\Phi_{EDGE3}\neq\Phi_{EDGE4}$, $\Phi_{EDGE1}\neq\Phi_{EDGE3}$, and $\Phi_{EDGE2}\neq\Phi_{EDGE4}$.

10. The golf ball of claim 1, wherein, for each one of the dimples having a non-circular plan shape defined by a low frequency periodic function mapped along a circular simple closed path, the average of the edge angles of all of the dimple profiles of that dimple is 11° to 16°.

11. The golf ball of claim 1, wherein, for each one of the dimples having a non-circular plan shape defined by a low frequency periodic function mapped along a circular simple closed path, the difference between the maximum edge angle and the minimum edge angle of all of the dimple profiles of that dimple is 0.5° to 6.0°.

12. The golf ball of claim 1, wherein, for each one of the dimples having a non-circular plan shape defined by a low frequency periodic function mapped along a circular simple closed path, the difference between the maximum edge angle and the average of the edge angles of all of the dimple profiles of that dimple is 3.00° or less.

13. A golf ball having a generally spherical surface and comprising a plurality of dimples on the spherical surface, wherein at least a portion of the plurality of dimples have a non-circular plan shape defined by a low frequency periodic function mapped along a simple closed path according to the following function:

$$Q(x)=F_{path}(l,scl,x)*F_{periodic}(s,a,p,x)$$

where $F_{path}$ is a circle, ellipse, or square of length l, with scale factor scl, defined along the vertices x, and $F_{periodic}$ is a sine, cosine, sawtooth wave, triangle wave, or square wave function with sharpness factor s, amplitude a, and period p defined at the vertices x, and period p is about 15 or less;

wherein the maximum absolute distance of any point on the plan shape from the simple closed path is about 0.015 inches to about 0.050 inches; and wherein each one of the dimples having a non-circular plan shape defined by a low frequency periodic function mapped along a simple closed path comprises a first dimple profile and a second dimple profile, the first dimple profile having a first edge angle ($\Phi_{EDGE1}$) and a second edge angle ($\Phi_{EDGE2}$) and the second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values.

14. The golf ball of claim 13, wherein at least two of $\Phi_{EDGE1}$, $\Phi_{EDGE2}$, $\Phi_{EDGE3}$ and $\Phi_{EDGE4}$ have values that differ by 1.0° to 6.0°.

15. A golf ball having a generally spherical surface and comprising a plurality of dimples on the spherical surface, wherein at least a portion of the plurality of dimples have a non-circular plan shape defined by a low frequency periodic function mapped along a simple closed path according to the following function:

$$Q(x)=F_{path}(l,scl,x)*F_{periodic}(s,a,p,x)$$

where $F_{path}$ is a circle, ellipse, or square of length l, with scale factor scl, defined along the vertices x, and $F_{periodic}$ is a low frequency periodic function with sharpness factor s, amplitude a, and period p defined at the vertices x, and period p is about 15 or less;

wherein the maximum absolute distance of any point on the plan shape from the simple closed path is about 0.015 inches to about 0.050 inches;

wherein the plurality of dimples having a non-circular plan shape defined by a low frequency periodic function mapped along a simple closed path have a Degree of Interdigitation DOI of about 0.05 to about 0.50, DOI being defined by the following equation:

$$DOI = \frac{1}{n}\sum_{k=1}^{n}\left(\frac{R_1 + R_2}{D} - 1\right)_k$$

where $R_1$ is the maximum radial distance of a first dimple having a first center, $R_2$ is the maximum radial distance of a second dimple having a second center, D is the distance between the first center and the second center, and the first dimple is adjacent to the second dimple on the surface; and wherein each one of the dimples having a non-circular plan shape defined by a low frequency periodic function mapped along a simple closed path comprises a first dimple profile and a second dimple profile, the first dimple profile having a first edge angle ($\Phi_{EDGE1}$) and a second edge angle ($\Phi_{EDGE2}$) and the second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values.

16. The golf ball of claim 15, wherein at least two of $\Phi_{EDGE1}$, $\Phi_{EDGE2}$, $\Phi_{EDGE3}$ and $\Phi_{EDGE4}$ have values that differ by 1.0° to 6.0°.

* * * * *